US011453533B2

(12) United States Patent
Zhang

(10) Patent No.: US 11,453,533 B2
(45) Date of Patent: Sep. 27, 2022

(54) ADJUSTABLE CAP FOR A CONTAINER

(71) Applicant: Lam Soon Trademark Limited, Rarotonga (CK)

(72) Inventor: Xiangyong Zhang, Foshan (CN)

(73) Assignee: Lam Soon Trademark Limited, Rarotonga (CK)

( * ) Notice: Subject to any disclaimer, the term of this patent is extended or adjusted under 35 U.S.C. 154(b) by 4 days.

(21) Appl. No.: 17/239,613

(22) Filed: Apr. 25, 2021

(65) Prior Publication Data

US 2022/0002041 A1 Jan. 6, 2022

(30) Foreign Application Priority Data

Jul. 6, 2020 (HK) ..... 32020010598.1

(51) Int. Cl.
*B65D 47/26* (2006.01)
*B65D 43/02* (2006.01)
*B65D 47/08* (2006.01)

(52) U.S. Cl.
CPC ..... *B65D 47/266* (2013.01); *B65D 43/0231* (2013.01); *B65D 47/08* (2013.01)

(58) Field of Classification Search
CPC .. B65D 47/266; B65D 43/0231; B65D 47/08; B65D 47/265
See application file for complete search history.

(56) References Cited

U.S. PATENT DOCUMENTS 923,895 A * 6/1909 Ryburg ..... B65D 47/265 220/821
2,780,395 A * 2/1957 Schlabach ..... B65D 47/265 222/516
2,877,937 A * 3/1959 Weir ..... B65D 5/76 222/452
4,288,006 A * 9/1981 Clover, Jr. ..... B65D 47/265 206/534
4,832,235 A * 5/1989 Palmer ..... A47G 19/24 222/370

(Continued)

FOREIGN PATENT DOCUMENTS

CN 108045739 A 5/2018
CN 108137196 A 6/2018

OTHER PUBLICATIONS

Search Report Chinese Patent Office dated Aug. 14, 2020.

*Primary Examiner* — Vishal Pancholi
*Assistant Examiner* — Bob Zadeh

(57) ABSTRACT

The invention provides a cap for a container. The cap comprises a cover member having an outlet and at least one first opening; a base member engageable with the container and having an inlet; an adjusting member co-axially connected with and rotatably movable relative to the cover member and the base member; the adjusting member having at least one second opening adapted to cooperate with the at least one first opening to define a fluid flow passageway connecting the inlet of the base member with the outlet of the cover member; wherein the adjusting member is actuatable at an exterior of the cap, such that actuation of the adjusting member causes the at least one second opening to rotate relative to the at least one first opening thereby varying a size of the fluid flow passageway connecting the inlet of the base member with the outlet of the cover member.

17 Claims, 4 Drawing Sheets

(56) References Cited

U.S. PATENT DOCUMENTS

| | | | | |
|---|---|---|---|---|
| 5,123,574 | A * | 6/1992 | Poulos | B65D 83/0409 215/253 |
| 8,875,926 | B2 * | 11/2014 | Grajqevci | B65D 17/4014 220/253 |
| 8,925,768 | B1 * | 1/2015 | Ismail | G01F 11/261 222/434 |
| 2013/0240535 | A1 * | 9/2013 | Grajqevci | B65D 51/22 220/524 |
| 2014/0076937 | A1 * | 3/2014 | Cavalier | B65D 47/265 222/481 |
| 2015/0083758 | A1 * | 3/2015 | Ismail | B67D 7/22 222/434 |

* cited by examiner

ADJUSTABLE CAP FOR A CONTAINER

FIELD OF THE INVENTION

The invention relates to a cap for use with a container, and particularly, but not exclusively, to a cap which allows users to adjust a flow rate of a liquid from the bottle.

BACKGROUND OF THE INVENTION

A variety of caps or covers for covering and/or sealing a container such as a bottle container, as well as dispensing content from said container have been developed for various purposes. Despite the fact that they are so widely used in daily life such as for containing food products such as cooking oils, dressings, dairy products or beverages; household products such as liquid cleaners and conditioners; as well as personal or health care products etc., there have been limited improvement in the functional design of these bottle caps. Most of the traditional bottle caps, lids or covers are configured with an outlet or an opening from which the content can be dispensed from the bottle, and a covering lid for closing or sealing said outlet when not in use. Some bottle caps in the market are designed with its outlet having a plurality of holes of different sizes which allows dispensing of the liquid content from the bottle at different flow rates. However, these designs generally require the user to reposition the bottle and/or to change their holding position in order to place the selected outlet hole with the desired size to be in alignment with the pouring direction. In most situations, the user will have to release his or her grip from the bottle and then, reposition the bottle and/or change his or her holding posture to align the pouring direction with another hole of a different size so as to vary the flow rate. This is particularly inconvenient to vary the flow rate of the content during the pouring action such as, for example, when the user may prefer to slow down the flow at nearly the end of the dispensing, which is undesirable.

Objects of the Invention

An object of the present invention is to provide a novel cap, lid or cover for use with a container of which flow rate of the liquid content is adjustable. A further object of the present invention is to mitigate or obviate to some degree one or more problems associated with known bottle caps or container covers, or at least to provide a useful alternative.

The above objects are met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In a first main aspect, the invention provides a cap for a container. The cap comprises a cover member having an outlet and at least one first opening; a base member engageable with the container and having an inlet; an adjusting member co-axially connected with and rotatably movable relative to the cover member and the base member; the adjusting member having at least one second opening adapted to cooperate with the at least one first opening to define a fluid flow passageway connecting the inlet of the base member with the outlet of the cover member; wherein the adjusting member is actuatable at an exterior of the cap, such that actuation of the adjusting member causes the at least one second opening to rotate relative to the at least one first opening thereby varying a size of the fluid flow passageway connecting the inlet of the base member with the outlet of the cover member.

In a second main aspect, the invention provides a cap for a container. The cap comprises a cover member having an outlet; a base member engageable with the container, the base member having an inlet; an adjusting member co-axially connected with and rotatably movable relative to the cover member and the base member; the adjusting member having at least one second opening adapted to cooperate with the inlet to define a fluid flow passageway connecting inlet of the base member to the outlet of the cover member; wherein the adjusting member is actuatable at an exterior of the cap, such that actuation of the adjusting member causes the at least one second opening to rotate relative to the inlet thereby varying size of the fluid flow passageway.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figure, of which.

DESCRIPTION OF PREFERRED EMBODIMENTS

Figure 1:
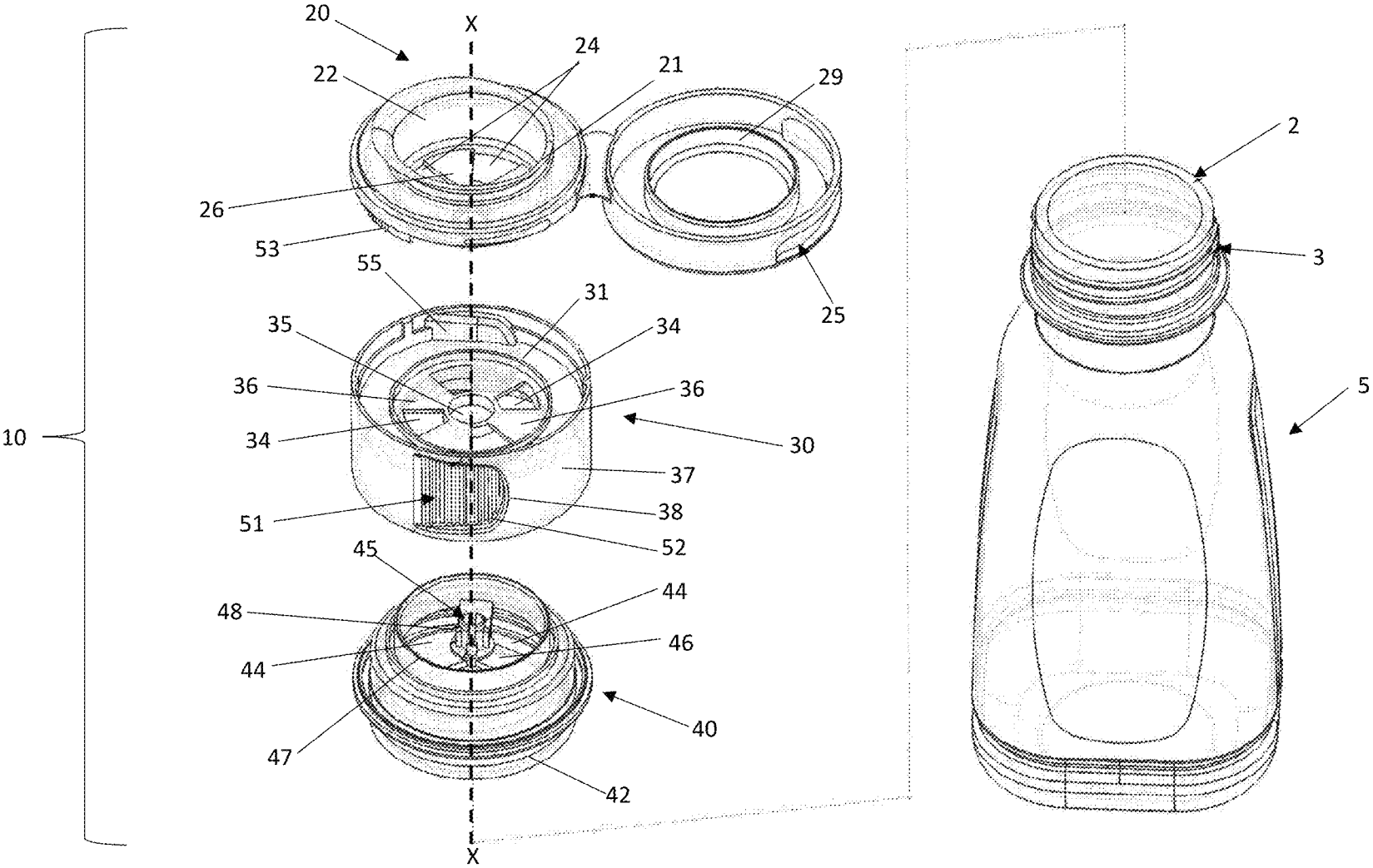
FIG. 1 is a perspective view of a cap for a container in accordance with an embodiment of the present invention.
Figure 2:
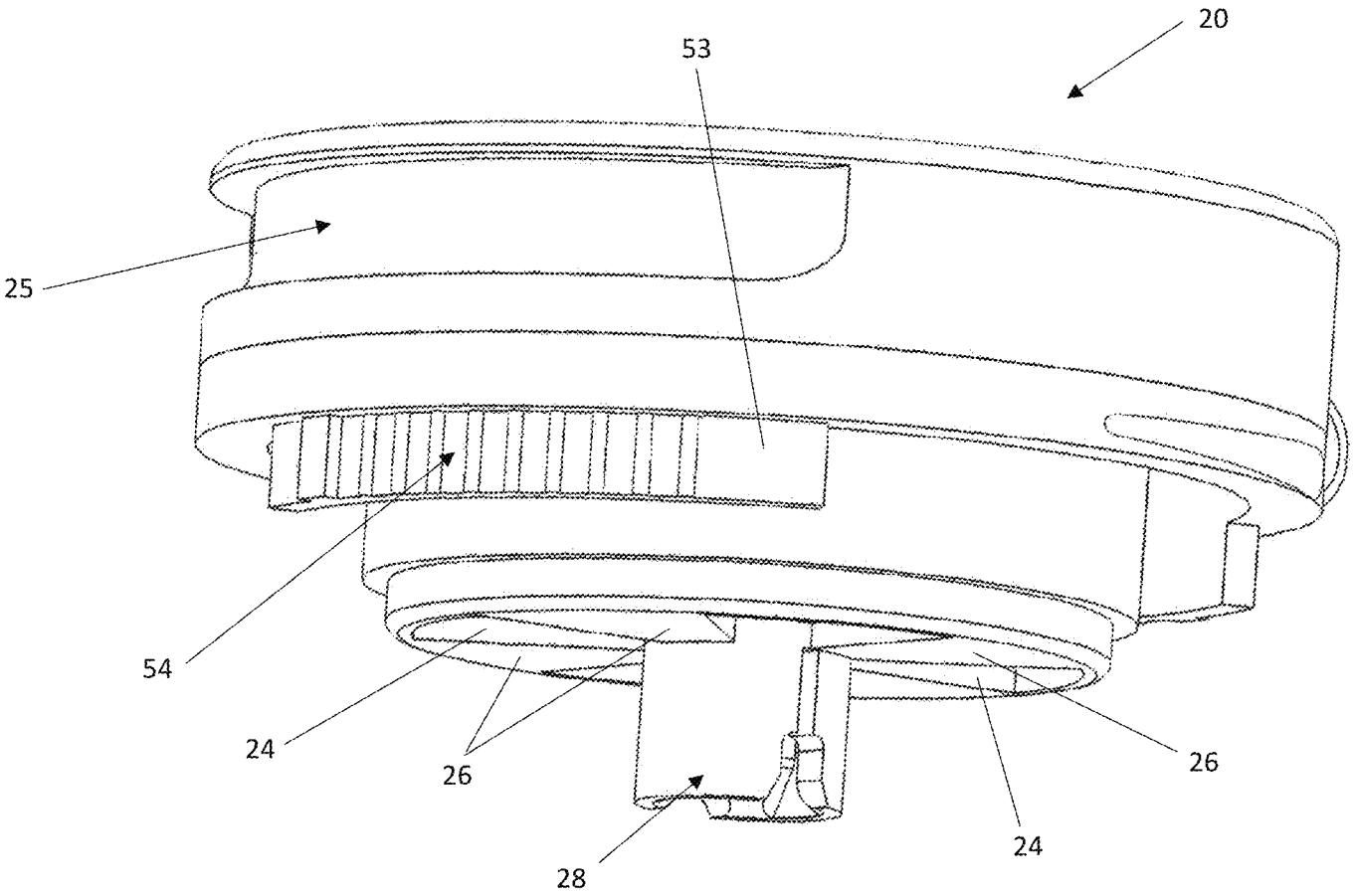
FIG. 2 shows another perspective view of the cover member of FIG. 1.
Figure 3:
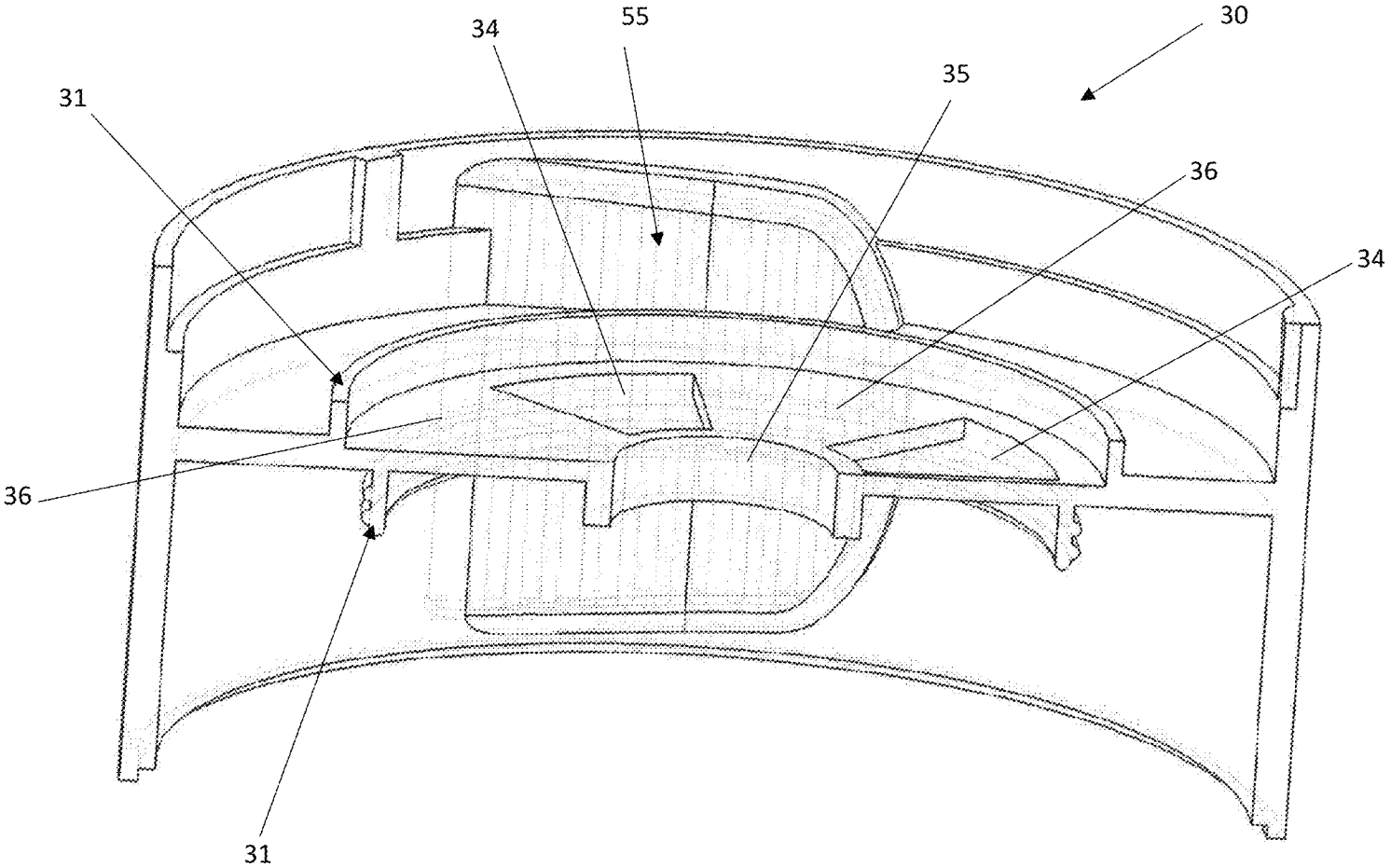
FIG. 3 shows a perspective, cross-sectional view of the adjusting member of FIG. 1.
Figure 4:
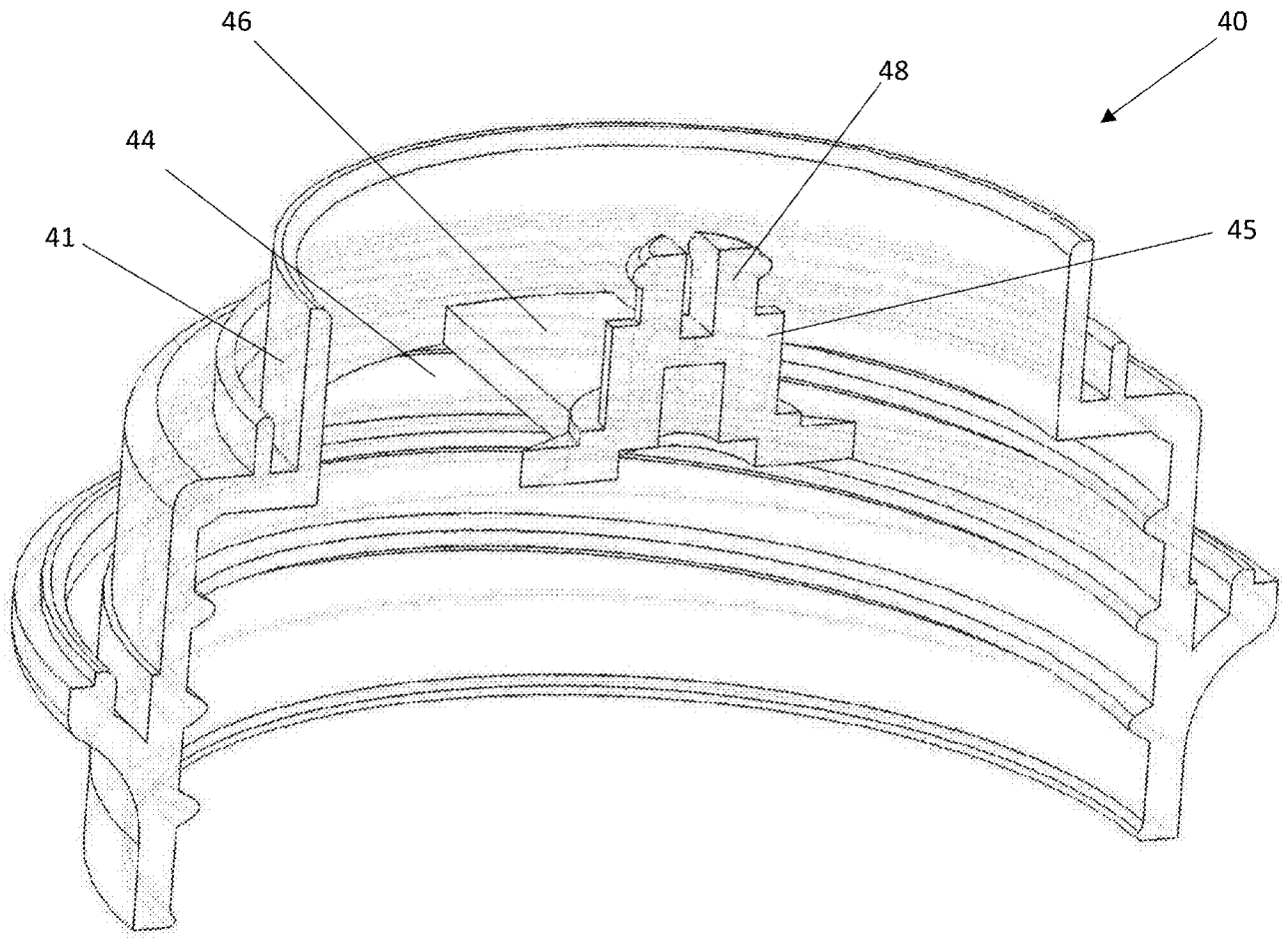
FIG. 4 shows a perspective, cross-sectional view of the base member of FIG. 1.

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The present invention relates to a cap, a cover or a lid in general for use in covering or sealing a container, and/or for dispensing a content from said container. The cap can be of any suitable shape and size, depending on the specific design, size and application of the container of which it is connected with, and can be made of any suitable materials such as, but are not limited to, polymers. The cap can be used to dispense content of substances of any suitable forms or states such as powder, cream or solid, and preferably, flowable content such as liquid. The cap can be used for any suitable domestic and/or commercial purposes. For example, the cap can be used with container for containing or storing liquid food products such as cooking oils, liquid condiments, beverages, dairy products as well as personal care products such as shampoo or liquid soaps, household or industrial cleaning liquids, medicine or even motor oil, etc. A person skilled in the art will appreciate that the present invention is not limited to any specific application.

In the embodiment as shown in the FIGS. 1-4, a cap 10 is provided in the form of a plastic flip cap for use with a plastic bottle 5 for containing, storing and/or dispensing a liquid such as, but not limited to, cooking oil or liquid condiments, for example. The cap 10 comprises a cover member 20 having an outlet 22 from which the liquid can be dispensed or poured from the bottle 5. The cap may further comprise a lid 25 for covering the outlet 22. In one embodiment, the cover member 20 may comprise at least one first opening 24, such as a plurality of first openings as shown in the figure. For example, the cover member 20 may be configured with four first openings 24 which are spaced apart by a plurality of corresponding first baffles 26, i.e. the first baffles 26 being arranged between the corresponding first openings 24. The plurality of the first openings 24 are preferably arranged in an opposing part of the cover member 20 relative to the outlet 22. For example, the outlet 22 of the cover member 20 is preferably arranged at an upper end of the cover member 20. In contrast, the first openings 24 are preferably arranged at a lower, distal end of the cover member 20 adjacent to an adjusting member 30 which will be discussed further below.

The cap 10 may comprise a base member 40 for preferably releasably engaging with an opening 2 of the container 5. In one embodiment, the base member 40 is configured with a threaded connecting portion 42 adapted to screw-threadedly engage with a corresponding threaded neck portion 3 of the bottle 5. However, one skilled in the art will appreciate that any other connecting methods such as a snap-fit connection, may also be applicable for connecting the cap 10 with the bottle 5. The base member 40 may comprise an inlet configured to be in fluid communication with the opening 2 of the container 5. In one embodiment, the inlet may comprise or be provided in the form of at least one third opening 44, as shown in the figures, which allows fluid communication between the opening 2 of the container 5 with the outlet 22 of the cover member 20.

The cap 10 may further comprise an adjusting member 30 co-axially connected with, and rotatably movable relative to at least the cover member 20 and preferably also the base member 40. In one embodiment, the cover member 20 and the base member 40 can be fixedly connected together, i.e. the cover member 20 and the base member 40 are not movable relative to the container 5, while the adjusting member is rotatable about the shared axis X-X between the cover member 20 and the base member 40. In one embodiment, the cover member 20 and the base member 40 are connectable via a central connector 45, which can be formed from a snap-fit connection between a resilient central protruding portion 48 of the base member 40 and a resilient central receiving portion 28 of the cover member 30, as shown in the figures. The adjusting member 30 can be receivably arranged at the central connector 45 via a central hole 35, and be rotatable about the central connector 45. In one specific embodiment, the cover member 20, the adjusting member 30 and the base member 40 when connected, form substantially a cylindrical shaped cap.

In one embodiment, the adjusting member 30 is configured with at least one second opening 34 adapted to cooperate with the at least one first opening 24 to define a fluid flow passageway which fluidly connects the outlet 22 of the cover member 20 with the inlet of the base member 40 and thus, opening 2 of the container 5. In one embodiment, the adjusting member 30 may comprise a plurality of second openings 34, such as four second openings 34 spaced apart by a plurality of corresponding second baffles 36, i.e. the corresponding second baffles 36 being arranged between the second openings 34, for example.

Preferably, the plurality of first baffles 26 of the cover member 20 are positioned in a lower part of the cover member 20, while the plurality of second baffles 36 of the adjusting member 30 are located in an upper part of the adjusting member 30, such that said plurality of second baffles 36 are positioned adjacent to the plurality of first baffles 26. More preferably, upper surfaces of the plurality of second baffles 36 of the adjusting member 30 are in sliding contact with lower surfaces of the plurality of first baffles 26 of the cover member 20, when the adjusting member 30 is rotatably adjusted relative to the cover member 20. Rotational movement or adjustment of a position of the adjusting member 30 relative to a fixed position of the cover member 20 causes said plurality of second openings 34 to move into and out of alignment with the plurality of first openings 24, thereby varying the size of the fluid flow passageway. In one preferred embodiment, the number, shape and size of the plurality of the first baffles 26 of the cover member 20 is substantially equal to the number, shape and size of the plurality of the second baffles 36 of the adjusting member 30, such that when the adjusting member 30 is rotated to a selected position relative to the cover member 20 for adjustment, the plurality of the first baffles 26 and the plurality of the second baffles 36 substantially close the fluid flow passageway. Similarly, when the adjusting member 30 is rotated to another selected position relative to the cover member 20, the plurality of the first baffles 26 and the plurality of the second baffles 36 are substantially aligned to provide a maximum liquid flow opening for the fluid flow passageway.

The plurality of second openings 34 are in fluid communication with the at least one third opening 44 of the base member 40. In one embodiment, the base member 40 may comprise a plurality of third openings 44 spaced apart via one or more corresponding third baffles 46, such as the three third openings 44 and the three third baffles 46 as shown in FIG. 1.

In one embodiment, the resilient central receiving portion 28 of the central snap-fit connector 45 is supported on the cover member 20 by the plurality of the first baffles 26; and the resilient central protruding portion 48 of the central connector 45 is supported on the base member 40 by the plurality of the third baffles 46, as shown in the figures.

Particularly, the adjusting member 30 is actuatable at an exterior of the cap 10, such as at an external circumferential side wall 37 of the adjusting member 30, so that actuation of the adjusting member 30 causes the at least one second opening 34 to move relative to the at least one first opening 24 and/or the at least one third opening 44 thereby varying size of the fluid flow passageway. The variation of size of the fluid flow passageway relates to a gradual change of size and/or shape of the passageway between a closed configuration and an open configuration of the passageway, with the size of the flow path being varied between its minimum, i.e.

when closed, to its maximum, i.e. when fully opened. In one embodiment, the adjusting member 30 can be actuated by a turning action by the user at an actuating portion 38 of the external circumferential wall 37. Turning of the adjusting member 30 causes the plurality of second openings 34 to rotate until the second openings 34 are aligned with the plurality of first openings 24 thereby gradually opening the fluid flow passageway from its minimum to its maximum. In one embodiment, the first openings 24/first baffles 26 and the second openings 34/second baffles 36 are preferred to be axially spaced at a sufficiently close distance which provides the required clearance for the relative movement therebetween but at the same time, allows the second baffles 36 to be sufficiently close by so as to block the first openings 24 with minimum leakage.

In one alternative embodiment, the adjusting member 30 can be actuated to rotate such that the plurality of second openings 34 are to cooperate with the plurality of third opening 44 to define the fluid flow passageway. In this case, turning of the adjusting member 30 causes the plurality of second openings 34 to rotate until the second openings 34 are gradually aligned with the plurality of third openings 44 to open the fluid flow passageway. Similarly, the second baffles 36 can be rotatably moved to gradually close the third openings 44 to thereby adjust the size of the fluid flow passageway from its maximum to minimum.

Preferably, one or more of the first openings 24, the second openings 34 and/or the third openings 44 can be configured in a fan shape which extends outwardly and radially increase in size from a respective centre of the cover member 20, the adjusting member 30, and/or the base member 40. More preferably, shape of the first openings 24 and the first baffles 26 are substantially consistent with the shape of the second openings 34 and the second baffles 36, such that when the adjusting member 30 is actuated to rotate, the second baffles 36 are moved to substantially block and thus close the first openings 24 to thereby close off the fluid flow passageway. Similarly, the second openings 34 can be shaped such that they can be rotatably moved to substantially unblock the first openings 24 to thereby open the fluid flow passageway. Furthermore, rotation of the adjusting member 30 in between the closed configuration and the open configuration of the passageway allows the second baffles 36 to partially block or unblock the first openings 24 and thus, provides a range of size adjustments of the fluid flow passageway in between the minimum and the maximum. In one preferred embodiment, the adjusting member 30 is rotatable relative to the cover member 20 at a maximum angle of rotation of about 180 deg, and more preferably, at about 45 deg to about 90 deg to allow a gradual variation in size of the fluid flow passageway. In one embodiment, at least one of the adjusting member 30, the cover member 20 and/or the base member 40 is indexed at its external, circumferential surface which indicates the degree of rotation of the adjusting member 30 and thus, the size of fluid flow passageway to the user.

In one embodiment, the actuating portion 38 at the external circumferential side wall 37 of the adjusting member 30 may comprise one or more ridges and/or indentations, or more preferably, comprises a plurality of ridges 51 arranged at one or more tapered indentations 52 at the side wall 37, as shown in FIG. 1. The ridges 51 and/or the indentations 52 are provided to assists gripping of the turnable adjusting member 30 by the user to facilitate actuation of the adjusting member 30. In one embodiment, the indentations 52 can be shaped to conform with fingers of the user, with the plurality of ridges 51 provide a frictional surface to assist with the gripping.

The cover member 20 and/or the base member 40 may further comprise one or more stopping means 53 which define the angle of rotation of the adjusting member 30 relative to the cover member 20 and/or the base member 40. For example, rotation of the adjusting member 30 can be stopped by the stopping means 53 provided at the cover member 20 when the stopping means 52 comes to abutment with the block 55 of the adjusting member 30 during a rotation. Preferably, the stopping means 53 may comprise a corrugated surface 54 such that, when the adjusting member 30 is arranged to rotate relative to the cover member 20 and/or the base member 40, the corrugated surface generates a tactile sensation and/or a sound to signal turning to the user. Alternatively, the stopping means may also be provided at the adjusting member 30 while the block be provided at one or more of the cover member 20 and/or the base member 40, which can also be configured to serve the same function.

In one embodiment, the cover member 20 may comprise a cover portion or lid 25 for covering or closing the outlet 22. The cover portion or lid 25 can be provided in the form of a flip-cap attached to the cover member 20, or may possibly be provided in the form of a snap cap or a screw cap. Preferably, the cover portion or lid 25 may comprise a sealing member or seal 29 adapted to seal the outlet 22 when the cover portion or lid 25 is arranged to close the outlet 22. In one further embodiment, one or more of the cover member 20, the adjusting member 30 and/or the base member 40 may optionally comprise one or more guiding portions 21, 31, 41 arranged to at least partially surround the fluid flow passageway for guiding the fluid flow from the opening 2 of the container 5 towards the outlet 22.

In yet a further embodiment, the invention relates to cap for a container. The cap comprises a cover member having an outlet; a base member releasably engageable with the container, with the base member comprising an inlet. The cap further comprises an adjusting member co-axially connected with and rotatably movable relative to the cover member and the base member. The adjusting member comprises at least one second opening adapted to cooperate with the inlet to define a fluid flow passageway connecting the inlet of the base member and the outlet with the cover member; wherein the adjusting member is actuatable at an exterior of the cap, such that actuation of the adjusting member causes the second opening to rotate relative to the inlet thereby varying size of the fluid flow passageway. In one embodiment, the adjusting member may comprise a plurality of second openings and the inlet of the base member may comprise a plurality of third openings, such that rotational adjustments of a position of the adjusting member relative to a fixed position of the base member causes said plurality of second openings to move into and out of alignment with the plurality of third openings to thereby vary the size of the fluid flow passageway.

The present invention is advantageous in that it provides a cap for a container such as a bottle cap which allows a convenient adjustment to vary the flow rate of the liquid content when dispensing the liquid content. The adjustment can be performed prior to the dispensing or during the course of dispensing of the liquid content. The flow rate adjustment is achieved by varying the size of the fluid flow passageway fluidly connecting the opening of the bottle and the outlet of the cap. The adjustment can be conducted by actuating the adjusting member at its exterior, with the adjusting member being positioned in between the cover member which defines the outlet, and the base member which engages the bottle. The variation to the size of the fluid flow passageway and thus the flow rate can be achieved by a simple turning action at an external circumference side wall of the adjusting member, which is easily accessible by the user even during a dispensing action of the liquid content. Since the variation of the flow rate is actioned by rotating the adjusting member relative to the cover member, variation to the size of the fluid flow passageway can be achieved by the relative positioning of the first openings/first baffles provided at the cover member and the second openings/second baffles provided at the adjusting member, regardless of the dispensing or pouring direction of the covering member. Therefore, in contrast to the prior art designs such as those being provided with a plurality of holes of different sizes at the outlet, no repositioning of the container and/or the holding direction by the user to align the dispensing/pouring direction with the selected hole will be required. In addition, unlike some other prior art designs in which the size of the dispensing opening will have to be preset prior to the dispensing action, the present invention allows the flow rate be adjusted even during the course of dispensing. For example, the flow rate can be decreased or increased by the user's turning of the adjusting member during a pouring of the liquid content, without significantly affecting the liquid flow from the outlet and/or altering the direction of liquid flow. It is therefore convenient to the user as he or she is not required to put down the container, adjust the size of the outlet opening and/or reposition the dispensing direction of the bottle to align it with a specific outlet hole, whenever an adjustment is required or before the dispensing. Furthermore, the present invention allows a gradual change in the size of the fluid flow passageway between its minimum and its maximum based on the relative rotation between the first openings/first baffles and the second openings/second baffles and therefore, it provides in effect a range of various adjustments to the flow rate between the closed configuration and the open configuration.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein.

Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims hereof, any element expressed as a means for performing a specified function is intended to encompass any way of performing that function. The invention as defined by such claims resides in the fact that the functionalities provided by the various recited means are combined and brought together in the manner which the claims call for. It is thus regarded that any means that can provide those functionalities are equivalent to those shown herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art is referred to herein, such prior art does not constitute an admission that the prior art forms a part of the common general knowledge in the art.

The invention claimed is:

1. A cap for a container, comprising:

a cover member having an outlet, a plurality of first openings arranged in an opposing part of the cover member relative to the outlet of the cover member, and a plurality of first baffles arranged between the plurality of first openings;

a base member engageable with the container and having an inlet;

an adjusting member co-axially connected with and rotatably movable relative to the cover member and the base member; the adjusting member having at least one second opening adapted to cooperate with the plurality of first openings to define a fluid flow passageway connecting the inlet of the base member with the outlet of the cover member;

wherein the adjusting member is actuatable at an exterior of the cap, such that actuation of the adjusting member causes the at least one second opening to rotate relative to the plurality of first openings thereby varying a size of the fluid flow passageway connecting the inlet of the base member with the outlet of the cover member.

2. The cap according to claim 1, wherein the cover member and the base member are fixedly connected together.

3. The cap according to claim 1, wherein the adjusting member comprises at least one actuating portion arranged at an external circumferential wall of the adjusting member.

4. The cap according to claim 1, wherein the adjusting member is arranged co-axially between the cover member and the base member.

5. The cap according to claim 1, wherein the adjusting member comprises a plurality of second openings arranged such that rotational adjustments of a position of the adjusting member relative to a fixed position of the cover member causes said plurality of second openings to move into and out of alignment with the plurality of first openings to thereby vary the size of the fluid flow passageway; and a plurality of second baffles arranged between the plurality of second openings.

6. The cap according to claim 5, wherein the plurality of the first baffles of the cover member are positioned in a lower part of the cover member and the plurality of second baffles of the adjusting member are located in an upper part of the adjusting member such that said plurality of second baffles of the adjusting member are positioned adjacent to the plurality of the first baffles of the cover member; and that upper surfaces of said plurality of second baffles of the adjusting member are in sliding contact with lower surfaces of the plurality of the first baffles of the cover member when the adjusting member is rotatably adjusted relative to the cover member.

7. The cap according to claim 6, wherein a number and size of the plurality of the first baffles of the cover member is equal to a number and size of the plurality of the second baffles of the adjusting member such that when the adjusting member is rotated to a selected position relative to the cover member, the plurality of the first baffles of the cover member and the plurality of the second baffles of the adjusting member close the fluid flow passageway; and when the adjusting member is rotated to another selected position relative to the cover member, the plurality of the first baffles of the cover member and the plurality of the second baffles of the adjusting member are aligned to provide a maximum liquid flow opening for the fluid flow passageway.

8. The cap according to claim 1, wherein the base member comprises at least one third opening in fluid communication with the second opening.

9. The cap according to claim 8, wherein the at least one third opening comprises a plurality of third openings spaced apart a plurality of third baffles.

10. The cap according to claim 9, wherein the cover member and the base member are co-axially connectable via a central connector, with the adjusting member being receivably arranged at and rotatable about the central connector, with a first part of the central connector being supported on the cover member by the plurality of the baffles of the cover member and a second part of the central connector being supported on the base member by the plurality of the third baffles of the base member.

11. The cap according to claim 8, wherein one or more of the plurality of first openings, the at least one second opening and/or the at least one third opening are configured to radially increase in size from a centre of the respective cover member, the adjusting member and/or the base member.

12. The cap according to claim 1, wherein the cover member and the base member are co-axially connectable via a central connector, with the adjusting member being receivably arranged at and rotatable about the central connector.

13. The cap according to claim 12, wherein a first part of the central connector is provided on the cover member and a second part of the central connector is provided on the base member; wherein the first part and second part of the central connector form a snap-fit connector.

14. The cap according to claim 1, wherein at least one of the cover member and the base member comprises one or more first stopping means for defining an angle of rotation of the adjusting member relative to the cover member and/or the base member;

wherein the one or more first stopping means comprise a corrugated surface such that, when the adjusting member rotates relative to the cover member and/or the base member, the corrugated surface is adapted to generate a tactile sensation and/or a sound.

15. The cap according to claim 1, wherein the adjusting member comprises one or more second stopping means for defining an angle of rotation of the adjusting member relative to the cover member and/or the base member; wherein the one or more second stopping means comprise a corrugated surface such that, when the adjusting member rotates relative to the cover member and/or the base member, the corrugated surface is adapted to generate a tactile sensation and/or a sound.

16. The cap according to claim 1, wherein one or more of the cover member, the adjusting member and/or the base member comprise one or more guiding portions around the fluid flow passageway for guiding flow of a fluid.

17. A cap for a container, comprising:

a cover member having an outlet;

a base member engageable with the container, the base member having an inlet comprises a plurality of third openings;

an adjusting member co-axially connected with and rotatably movable relative to the cover member and the base member; the adjusting member having a plurality of second openings adapted to cooperate with the inlet to define a fluid flow passageway connecting the inlet of the base member to the outlet of the cover member;

wherein the adjusting member is actuatable at an exterior of the cap, such that actuation of the adjusting member causes the plurality of second openings to rotate relative to the inlet; the plurality of second openings of the adjusting member and the plurality of third openings of the base member are arranged such that rotational adjustments of a position of the adjusting member relative to a fixed position of the base member causes said plurality of second openings to move into and out of alignment with the plurality of third openings to thereby vary the size of the fluid flow passageway.

* * * * *